US005232101A

United States Patent [19]

Shaftner et al.

[11] Patent Number: 5,232,101

[45] Date of Patent: Aug. 3, 1993

[54] SPORTS BALL STORAGE DEVICE

[76] Inventors: Tim K. Shaftner, 305 Silversmith La., Charlotte, N.C. 28270; John L. Bean, 920 Creekview Ct., Charlotte, N.C. 28214

[21] Appl. No.: 929,967

[22] Filed: Aug. 14, 1992

[51] Int. Cl.[5] ..... A47F 7/00

[52] U.S. Cl. ..... 211/14; D6/552

[58] Field of Search ..... 211/107, 14, 88; D6/552

[56] References Cited

U.S. PATENT DOCUMENTS

| | | | |
|---|---|---|---|
| 1,548,692 | 8/1925 | Wannenwetsch | 211/88 X |
| 3,522,887 | 8/1970 | Petersen | 211/14 |
| 3,525,440 | 8/1970 | Anderson | 211/14 |
| 4,002,241 | 1/1977 | Parrilla, Sr. . | |
| 4,119,247 | 10/1978 | Newquist et al. | 211/14 X |
| 4,154,356 | 5/1979 | Schieve | 211/88 X |
| 4,502,576 | 3/1985 | Reardon . | |
| 4,561,547 | 12/1985 | Estwanik | 211/14 |
| 4,629,065 | 12/1986 | Braaten . | |
| 4,865,237 | 9/1989 | Allen | 211/88 X |
| 5,074,571 | 12/1991 | Reese | 211/14 X |
| 5,085,320 | 2/1992 | Scott . | |

*Primary Examiner*—Robert W. Gibson, Jr.
*Attorney, Agent, or Firm*—Shefte, Pinckney & Sawyer

[57] ABSTRACT

A sports ball storage device includes a frame assembly comprised of at least two U-shaped members joined at their base portions and attached to a support ring having an insertion and removal opening formed therein, a cover, and a bracket for mounting the device to a pole or other stationary member.

9 Claims, 2 Drawing Sheets

SPORTS BALL STORAGE DEVICE

BACKGROUND OF THE INVENTION

The present invention relates broadly to devices for storing sports equipment, and more particularly, to a device for storing sports balls which can be attached to a pole or other upright member.

Whether on the playground or at home, keeping up with sports balls such as basketballs, soccer balls or the like, can be a frustrating experience. On the playground, a group of people shooting basketball will typically use more than one ball and then if a game starts the other balls which are not used must be set aside for future use. These balls may roll away, become lost, misplaced or stolen. At home, people, including children and adults, often play basketball in their driveways or backyards and at the conclusion of play the balls may be simply left in the yard where they last hit the ground. Loose sports balls in the yard can leave a cluttered appearance and provide obstacles to other lawn activities. Further, balls left in the yard may be stolen.

While the above discussion is centered on basketballs, it should be understood that the same problems may arise with regard to soccer balls, footballs, four-square balls, and the like. Accordingly, there exists a need for a device to store sports balls near the playing field or court in a manner that provides ready access to the balls for authorized users but may be locked to prevent others from taking the balls when the owners are not present.

SUMMARY OF THE INVENTION

It is accordingly an object of the present invention to provide a sports ball storage device which solves the aforementioned problems. Specifically, it is an object of the present invention to provide a sports ball storage device which can be mounted on a pole or other structural member for releasably containing at least one sports ball when the ball is not in use.

According to the present invention, the sports ball storage device includes an assembly for releasably containing at least one sports ball when the ball is not in use, the containment assembly having a ball insertion and removal opening formed therein, a bracket assembly for mounting the containment assembly on a support structure and a cover arrangement for selectively opening and closing the ball insertion and removal opening for access to the contents of the containment assembly. It is preferred that the sports ball storage device further include a latching assembly for releasably latching the cover arrangement in a closed disposition, the latching assembly including an arrangement for accommodating a lock for securing the cover arrangement in a closed disposition.

Preferably, the containment assembly includes at least two U-shaped members, each having a generally curved base portion and two upstanding arm portions. The U-shaped members are attached to one another at substantially the midpoint of their respective base portions and a support ring defining the insertion and removal opening is fixed to the arm portions. The cover arrangement includes a generally planar disk conforming substantially to the insertion and removal opening, the cover arrangement being hingedly fixed to the bracket assembly for movement in and out of a disposition overlying the insertion and removal opening. The bracket assembly is configured for fixedly attaching the containment assembly to a pole or other stationary upright member.

DESCRIPTION OF THE PREFERRED EMBODIMENT

Figure 1:
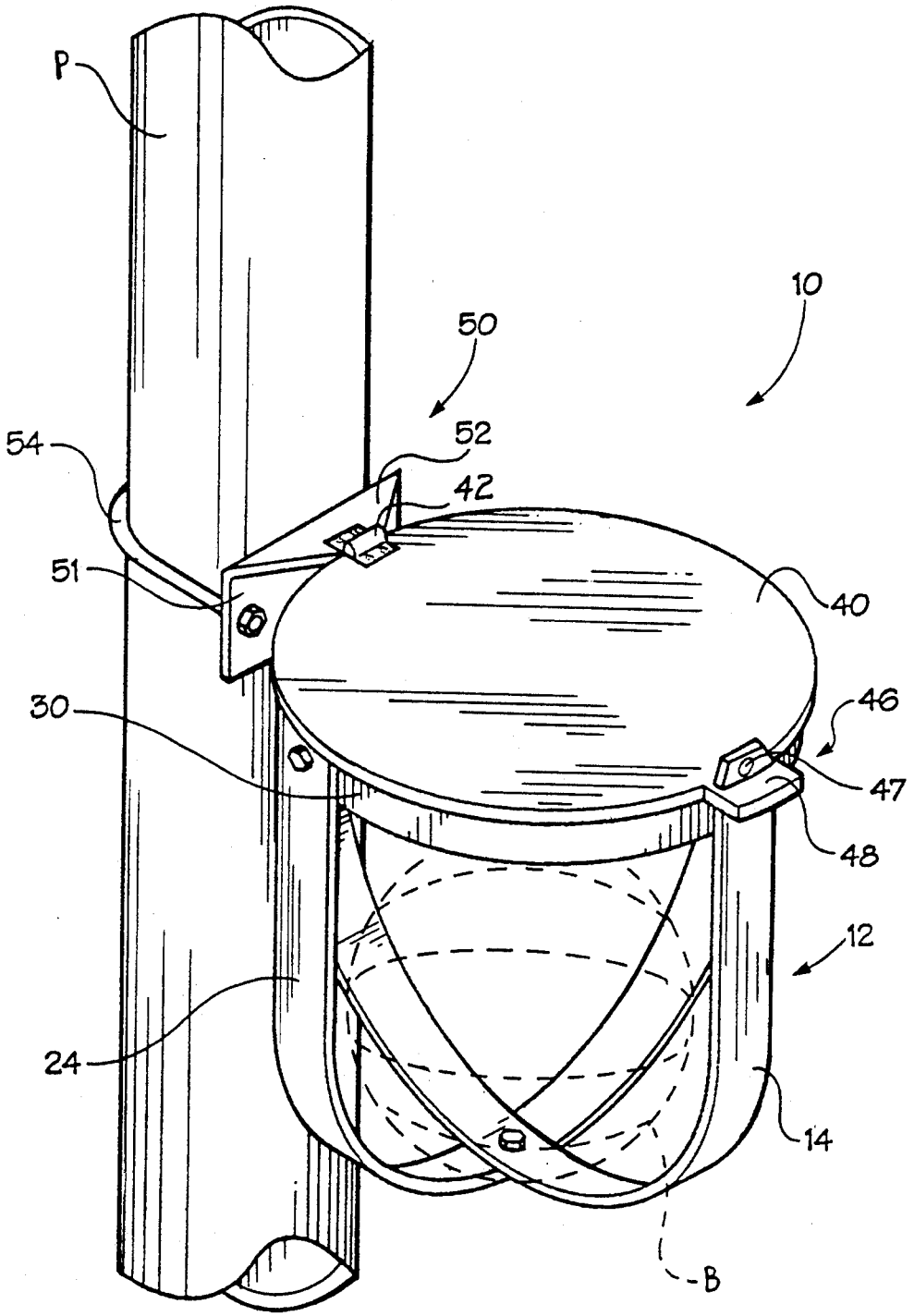
FIG. 1 is a perspective view of a sports ball storage device according to the preferred embodiment of the present invention.

Referring now to the accompanying drawings and more particularly to FIG. 1, a sports ball storage device according to the preferred embodiment of the present invention is indicated generally at 10 and basically includes a containment frame assembly 12, a cover 40 and a bracket assembly 50 for mounting the device 10 on a pole P or other stationary object. A basketball B is indicated in broken lines to illustrate the manner in which the present invention is used to store sports balls.

Figure 2:
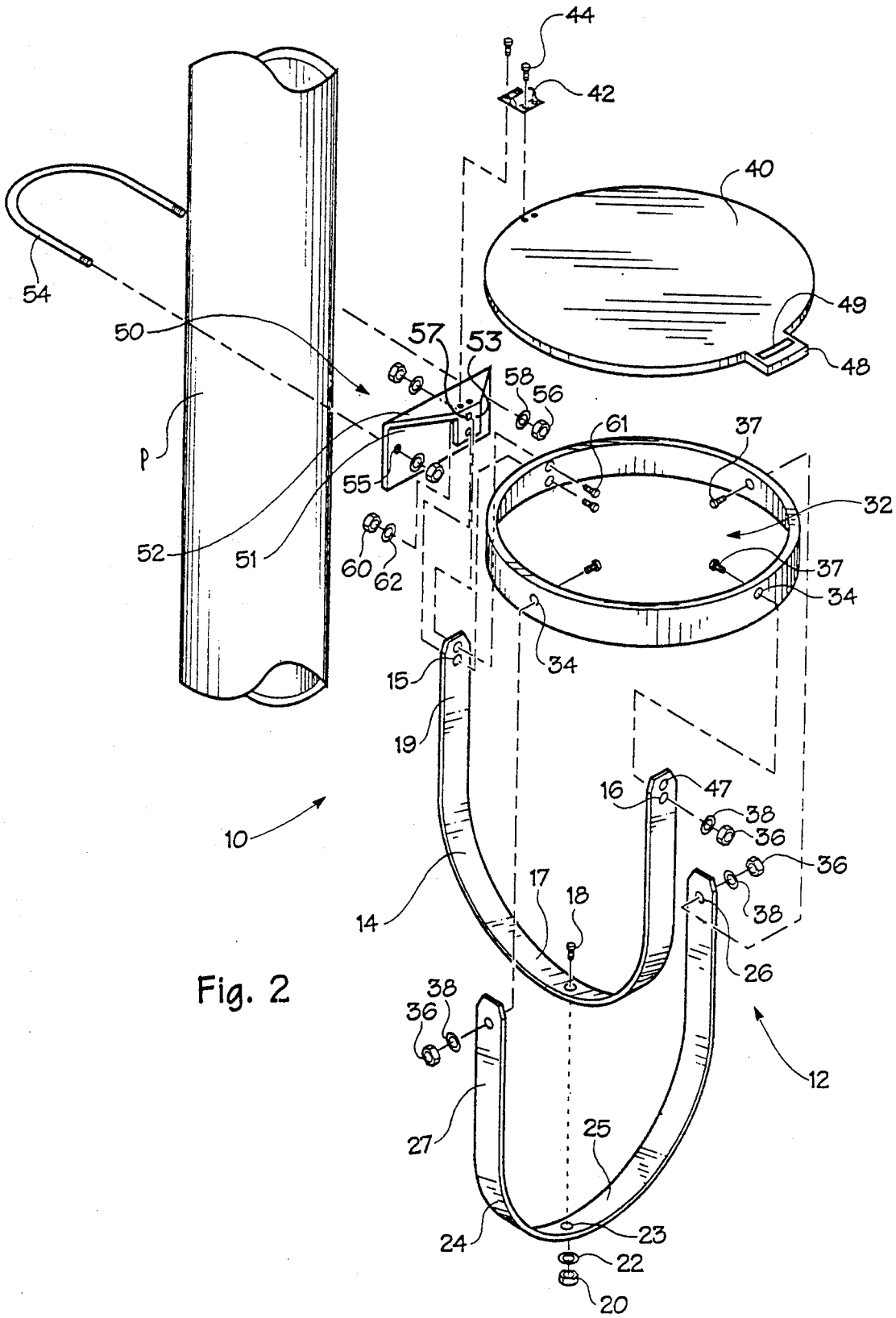
FIG. 2 is an exploded, perspective view of the sports ball storage device illustrated in FIG. 1.

Referring now to FIG. 2, the containment frame assembly 12 includes two U-shaped members 14, 24, each U-shaped member 14, 24 being a generally flat metal bar formed in the shape of a "U" thereby forming a member having two upstanding arm portions 19, 27 and a curved base portion 17, 25. Each U-shaped member has at least one hole formed in each end of each arm portion 19, 27 thereof. The first U-shaped member 14 includes two holes formed at the end of each arm portion 19 thereof. At the end of one arm portion 19, a pair of holes 15 provides a mounting location for mounting the device 10 to the bracket assembly 50. At the opposite end of the arm portion 19 of the first U-shaped member 14, a second pair of holes includes a support ring mounting hole 16 and a lock hole 47 for accommodation of the shank of a padlock, as will be explained in greater detail hereinafter. The second U-shaped member 24 includes a support ring mounting hole 26 formed in each end of the arm portions 27 thereof. Each U-shaped member 14, 24 also has a hole 23 formed in each base portion 17, 25 thereof. The U-shaped members 14, 24 are attached to one another generally at the midpoint of their respective base portions 17, 25 using the base holes 23 and a conventional nut 18, bolt 20 and washer 22 and are arranged perpendicularly with one another with the arm portions 19, 27 thereof projecting upwardly. Accordingly, when the U-shaped members 14, 24 are attached together they define a containment area (see FIG. 1).

A support ring 30 is provided to be mounted to the upstanding arm portions 19, 27 of the U-shaped members 14, 24 to provide structural stiffness to the device 10 and to define an insertion and removal opening 32. The support ring 30 is a generally flat metal bar formed into a circular shape having holes 34 formed therein at generally 90° intervals to be coincident with the holes 15, 16, 26 formed in the U-shaped members. The support ring 30 is secured to the U-shaped members 14, 24 using conventional bolts 37 passing through the holes 34 formed in the support ring and the holes 15, 16, 26 formed in the U-shaped members 14, 24 and being secured thereto using conventional nuts 36 and washers 38. It should be understood that while the preferred embodiment of the present invention is directed to containment of a single sports ball, the U-shaped members may be formed with longer arm portions 19, 27 so that the frame assembly 12 may be configured to contain more than one sports ball.

The frame assembly 12 may be affixed to a pole P or other upstanding member using the bracket assembly 50. The bracket assembly 50 includes a bracket member 51 which is a generally planar rectangular member having holes 55 formed in each end thereof. Projecting perpendicularly outwardly from the bracket member 51 is a generally triangular flange portion 52. A mounting lip 53 having a pair of holes 57 formed therein projects downwardly and generally perpendicularly from the flange portion 52 in generally parallel relation with the bracket member 51. The bracket member 51, the flange portion 52, and lip 53 are all integrally formed. A generally U-shaped rod member 54 having threaded end portions is configured to partially encircle the pole P with the threaded end portions projecting through the openings 55 formed in the bracket member 51 and is secured to the pole P using conventional washers 58 and nuts 56 which are threadedly attached to the ends of the U-shaped rod member 54.

The frame assembly 12 is attached to the lip portion 53 by aligning holes 34 formed in the support ring 30 with the holes 15 formed in the first U-shaped member 14 and the holes 57 formed in the lip portion 53. Conventional bolts 61 are passed therethrough to which conventional washers 62 and nuts 60 are threadedly attached. It should be understood that while the preferred embodiment of the present invention is configured for attachment to a elongate cylindrical pole P such as that supporting a basketball goal, the present invention is readily adaptable to be secured to a square pole by substituting an appropriately shaped member for the U-shaped rod member 54 or it may be attached to a wall using conventional screws, bolts or other fasteners.

To prevent unauthorized removal of the contents of the sports ball storage device 10 of the present invention, the cover 40 is provided. The cover 40 is a generally planar disk configured to fully cover the insertion and removal opening 32. A latching lip 48 projects radially outwardly from the cover 40 and is located in a position to engage a portion of the first U-shaped member 14. A generally rectangular opening 49 is formed in the latching lip 48 through which the upper portion of the first U-shaped member 14 projects when the cover 40 is in a closed disposition. The cover is pivotably attached to the bracket assembly 50 using a hinge 42 secured to the cover 40 and to the flange portion 52 of the bracket assembly 50 using conventional screws 44. Accordingly, the cover 40 may be raised and lowered out of and into a covering disposition with the insertion and removal opening 32. The cover 40 is supported in its closed condition by circumferential contact with the support ring 30.

With reference to FIG. 1, the aforementioned first U-shaped member 14 and the latching lip 48 of the cover 40 form together a latching assembly 46. When the cover 40 is in its closed disposition, a portion of the first U-shaped member 14 extends through the opening 49 formed in the latching lip 48 to the extent that the lock hole 47 is completely exposed and accessible with the cover 40 in a fully closed disposition. To lock the cover 40 and thereby deny access to the contents of the containment frame assembly 12. a conventional padlock, combination lock or some other lock (not shown) may have its shank portion inserted through the lock hole 47 thereby preventing anyone from lifting the cover 40 to access the contents of the containment frame assembly 12.

Operation of the sports ball storage device 10 of the present invention is generally as follows. Initially, the sports ball storage device 10 must be assembled and mounted to a pole P or some other upright member in the manner previously described. The device 10 should be mounted at a height that is accessible by all persons authorized to use the sports balls stored therein. Additionally, if the device 10 is to be used on a basketball goal support member, it should be arranged so as to face away from the playing area. When play has ended, the cover 40 is raised exposing the insertion and removal opening 32. The sports ball B to be stored is then inserted through the insertion and removal opening 32 to be contained within the containment frame assembly 12. The curved portions of the U-shaped members 14, 24 provide cradling for the ball stored in the device 10. The cover 40 is then lowered with the aforementioned portion of the first U-shaped member 14 projecting through the opening 49 formed in the latching lip 48 of the cover 40 to expose the lock hole 47 above the cover 40. Should the device need to be locked, a conventional padlock or combination lock (not shown) may have its shank passed through the lock hole 47 as previously described.

As can be seen from the above, the present invention provides a neat and effective method of storing a sports ball near the area where it will be used. In addition, the present invention provides a lockable storage container for prevention of theft and unauthorized use of sports balls. Further, the cover protects the balls within the containment area from the effects of the weather. Accordingly, the present invention is particularly adaptable to home use, and also to school yards, playgrounds and other public areas where an unattended ball may be stolen.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A sports ball storage device comprising means for releasably containing at least one basketball when said basketball is not in use, said containment means having an interior storage area configured and dimensioned to substantially conform to the basketball and defining a basketball insertion and removal opening; bracket means for mounting said containment means on a support structure; and cover means for selectively opening and closing said basketball insertion and removal opening for access to said containment means.

2. A sports ball storage device according to claim 1 and further comprising latching means for releasably latching said cover means in a closed disposition, said latching means including means for accommodating a lock for securing said cover means in a closed disposition.

3. A sports ball storage device according to claim 1 wherein said containment means includes at least two U-shaped members, each having a generally curved base portion and two upstanding arm portions, said U-shaped members being attached to one another at generally the midpoint of their respective base portions; and a support ring defining said insertion and removal opening and being fixed to said arm portions.

4. A sports ball storage device according to claim 1 wherein said bracket means is configured for fixedly attaching said containment means to a pole or other stationary upright member.

5. A sports ball storage device according to claim 1 wherein said cover means includes a generally planar disc conforming substantially to said insertion and removal opening, said cover means being hingedly fixed to said bracket means for movement in and out of a disposition overlying said insertion and removal opening.

6. A sports ball storage device comprising means for releasably containing at least one sports ball when said ball is not in use, said containment means including at least two U-shaped members, each having a generally curved base portion and two upstanding arm portions, said U-shaped members being attached to one another at generally the midpoint of their respective base portions, and a support ring defining an insertion and removal opening and being fixed to said arm portions; bracket means for mounting said containment means on a support structure; and cover means for selectively opening and closing said ball insertion and removal opening for access to said containment means.

7. A sports ball storage device according to claim 6 and further comprising latching means for releasably latching said cover means in a closed disposition, said latching means including means for accommodating a lock for securing said cover means in a closed disposition.

8. A sports ball storage device according to claim 6 wherein said bracket means is configured for fixedly attaching said containment means to a pole or other stationary upright member.

9. A sports ball storage device according to claim 6 wherein said cover means includes a generally planar disc conforming substantially to said insertion and removal opening, said cover means being hingedly fixed to said bracket means for movement in and out of a disposition overlying said insertion and removal opening.

* * * * *